US005611425A

United States Patent [19]

Holley, Jr.

[11] Patent Number: 5,611,425

[45] Date of Patent: Mar. 18, 1997

[54] LOCK FOR BASKET SYTLE CARRIER

[75] Inventor: John M. Holley, Jr., Lawrenceville, Ga.

[73] Assignee: The Mead Corporation, Dayton, Ohio

[21] Appl. No.: 508,412

[22] Filed: Jul. 28, 1995

[51] Int. Cl.[6] ..... B65D 5/48

[52] U.S. Cl. ..... 206/144; 206/173; 206/193; 229/195; 493/137

[58] Field of Search ..... 206/139.2, 144, 206/147, 170–175, 193–194, 187, 197–199, 200, 427; 229/125.28, 149, 195, 198.2; 493/115, 137, 136, 139

[56] References Cited

U.S. PATENT DOCUMENTS

| | | | |
|---|---|---|---|
| 2,832,270 | 4/1958 | Pierce, Jr. et al. | 493/136 |
| 2,837,261 | 6/1958 | Stenger | 229/195 |
| 3,084,831 | 4/1963 | Arneson | 206/187 |
| 3,784,053 | 1/1974 | Stout | 206/193 |
| 3,997,051 | 12/1976 | Graser et al. . | |
| 4,029,205 | 6/1977 | Wood . | |
| 4,171,046 | 10/1979 | Bonczyk | 206/193 |
| 4,187,944 | 2/1980 | Wood . | |
| 4,253,564 | 3/1981 | Engdahl, Jr. | 206/187 |
| 4,336,878 | 6/1982 | Wood . | |
| 4,413,728 | 11/1983 | Wood . | |
| 4,708,284 | 11/1987 | Sutherland et al. | 493/137 |
| 4,927,009 | 5/1990 | Stout . | |
| 4,989,779 | 2/1991 | Lashyro | 206/173 |

FOREIGN PATENT DOCUMENTS

0280095A1 8/1988 European Pat. Off. .

0481599A1 4/1992 European Pat. Off. .

*Primary Examiner*—Bryon P. Gehman
*Assistant Examiner*—Luan K. Bui
*Attorney, Agent, or Firm*—Thomas A. Boshinski

[57] ABSTRACT

A carrier for a plurality of objects arranged in at least two rows includes substantially parallel first and second side walls, substantially parallel first and second end walls interconnecting the side walls, a medial panel extending between and connected to the first and second end walls, the medial panel being disposed between and substantially parallel to the first and second side walls, a primary bottom wall connected and extending between lower portions of said first and second side walls, and a lock for maintaining the carrier in an erect condition, the lock including a lock body connected to a lower edge of the medial panel and depending downwardly therefrom, a first retention tab disposed along a first side edge of the lock body spaced from the medial panel, and a second retention tab disposed along a second side edge of the lock body spaced from the medial panel, whereby the first and second retention tabs define a retention width for the lock extending between the outermost portions of the first and second retention tabs, and a throat for the lock body having a throat width extending between the first and second edges between the retention tabs and the medial panel, and wherein the primary bottom wall defines a locking aperture therein for cooperative engagement with the locking tab when the carrier is in an erected condition, the aperture having a length less than the retention width and greater than the throat width.

8 Claims, 8 Drawing Sheets

LOCK FOR BASKET SYTLE CARRIER

BACKGROUND OF THE INVENTION

The present invention relates generally to paperboard carriers for articles such as beverage bottles. More particularly, it relates to a basket-style carrier in which a lock is provided to maintain the carrier in an erected condition for loading.

One traditional paperboard carrier for articles such as beverage bottles is the basket-style carrier. An example of such a carrier is shown in U.S. Pat. No. 4,927,009. The carrier includes side, end and bottom walls, and is typically used with articles grouped in two rows. Located between the two rows is a medial panel which connects the end walls and includes an opening to provide a handle by which the basket may be carried. In its usual form, this carrier also includes partition panels extending between the medial panel and the side walls, to define individual cells into which the articles may be placed.

Basket-style carriers are normally manufactured and shipped in a glued but collapsed condition. The end walls are folded at the medial panel, so that they are collapsed onto themselves to bring the side walls together. The medial panel is thus displaced longitudinally with respect to the side walls. For use, such as at a beverage bottling facility, the basket is erected by moving the medial panel back into alignment with the side walls. The end walls are brought into an unfolded position, and the set-up basket is available to be loaded with the articles to be carried.

There is a tendency for such carriers to collapse back to their original condition. Once the bottles have been loaded, it is not possible for the carton to collapse, but in the period between erecting the carton and loading the bottles, it is necessary to this occurrence. It is known therefore to provide various lock arrangements to hold the carrier in erected condition. For example, a hook-like lock may be provided on the lower edge of the central medial panel to engage a notch formed in the bottom wall, as shown in U.S. Pat. No. 4,187,944. Two such locks may also be provided, one lock engaging each side edge of the bottom wall, as shown in U.S. Pat. No. 4,336,878. As an alternate approach, it is known to provide a hook-like lock which engages an aperture in the bottom panel at a location intermediate the side edges. This type of lock may require additional provisions to keep the lock in engagement, such as the flap provided adjacent the aperture as shown in European Published Application No. 0 481 599 A1. This requires additional manipulation of the carrier during erecting to close the flap, and the flap manipulation weakens the folded connection for the flap, increasing the possibility of inadvertent disengagement of the lock during use.

Accordingly, a need still exists for a lock for a basket-style carrier which can be easily engaged as the carrier is erected, and that reliably and securely maintains its engagement during carrier loading and subsequent use.

SUMMARY OF THE INVENTION

The present invention provides a carrier for a plurality of objects arranged in at least two rows, the carrier including substantially parallel first and second side walls, substantially parallel first and second end walls interconnecting the side walls, a medial panel extending between and connected to the first and second end walls, the medial panel being disposed between and substantially parallel to the first and second side walls, and a primary bottom wall connected and extending between lower portions of the first and second side walls. A lock for maintaining the carrier in an erect condition comprises a lock body connected to a lower edge of the medial panel and depending downwardly therefrom, with the lock body defining first and second side edges.

A first retention tab is disposed along the first side edge of the lock body spaced from the medial panel, and a second retention tab is disposed along the second side edge of the lock body spaced from the medial panel. The first and second retention tabs define a retention width for the lock extending between the outermost portions of the first and second retention tabs, and a throat for the lock body having a throat width extending between the first and second edges between the retention tabs and the medial panel. The primary bottom wall defines a locking aperture therein for cooperative engagement with the locking tab when the carrier is in an erected condition, the aperture having a length less than the retention width and greater than the throat width.

The carrier may further include first partition structure connected and extending between the first and second end walls and disposed between the medial panel and said first side wall, and second partition structure connected and extending between the first and second end walls and disposed between the medial panel and the second side wall. A secondary bottom wall connects and extends between lower portions of the first partition structure and the second partition structure, disposed in overlapping relationship with the primary bottom wall. The secondary bottom wall defines a locking aperture therein disposed in alignment with and having a length equal to the locking aperture of the primary bottom wall.

The lock body may further define a lowermost edge, and a retention notch defined in the lowermost edge for temporarily retaining an edge of the locking aperture during engagement of the aperture with the lock body.

The invention also provides a method for locking the carrier into an erected condition, the method including the steps of causing relative movement between the medial panel and the primary bottom wall to position the locking aperture beneath the locking tab such that the first retention tab is in alignment with the aperture, and causing relative movement between the medial panel and the primary bottom wall to cause the first retention tab to pass through the locking aperture but with an edge of the aperture disposed against a lowermost edge of the lock body. The method is completed by causing relative movement between the medial panel and the primary bottom wall to move the locking aperture inwardly into the lock throat adjacent the first retention tab, and causing relative movement between the medial panel and the primary bottom wall to cause the second retention tab to pass through the locking aperture.

In the method, if the lowermost edge of the lock body defines a retention notch, the edge of the aperture when disposed against the edge of the lock body may be disposed within the notch.

DETAILED DESCRIPTION OF THE PREFERRED EMBODIMENT

Figure 1:
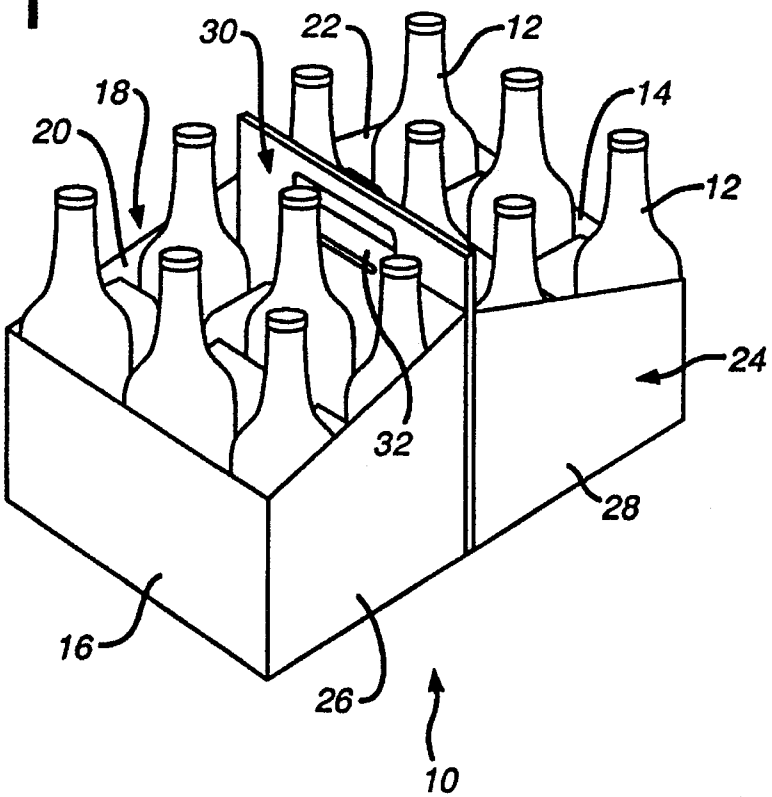
FIG. 1 is a perspective view of a carrier in accordance with a preferred embodiment of the present invention, showing the carrier in set-up condition and with beverage bottles loaded therein.

Referring generally now to FIG. 1, the present invention provides an article carrier 10 for carrying articles such as beverage bottles 12. While the carrier 10 is described therein generally in connection with the carrying of beverage bottles 12, it will be recognized that the carrier is suitable for the carrying of other products, such as non-beverage products packaged in bottles, beverage and non-beverage products packaged in cans, and other liquid and non-liquid products.

Further, while the preferred embodiment described herein comprises a carrier for four rows of bottles 12, the invention is not limited to such a carrier and may be used with a more common, two-row basket carrier.

The carrier 10 includes a first side wall 14 and a second side wall 16. Connecting the side walls are a first end panel 18, formed of end panel 20 and end panel 22, and second end wall 24, formed of end panels 26 and 28. Extending between end walls 18 and 24, disposed between the second and third rows of bottles 12, is a medial panel 30. Medial panel 30 is provided near its upper end with an opening 32 that provides a handle by which the carrier 10 may be lifted.

Figure 2:
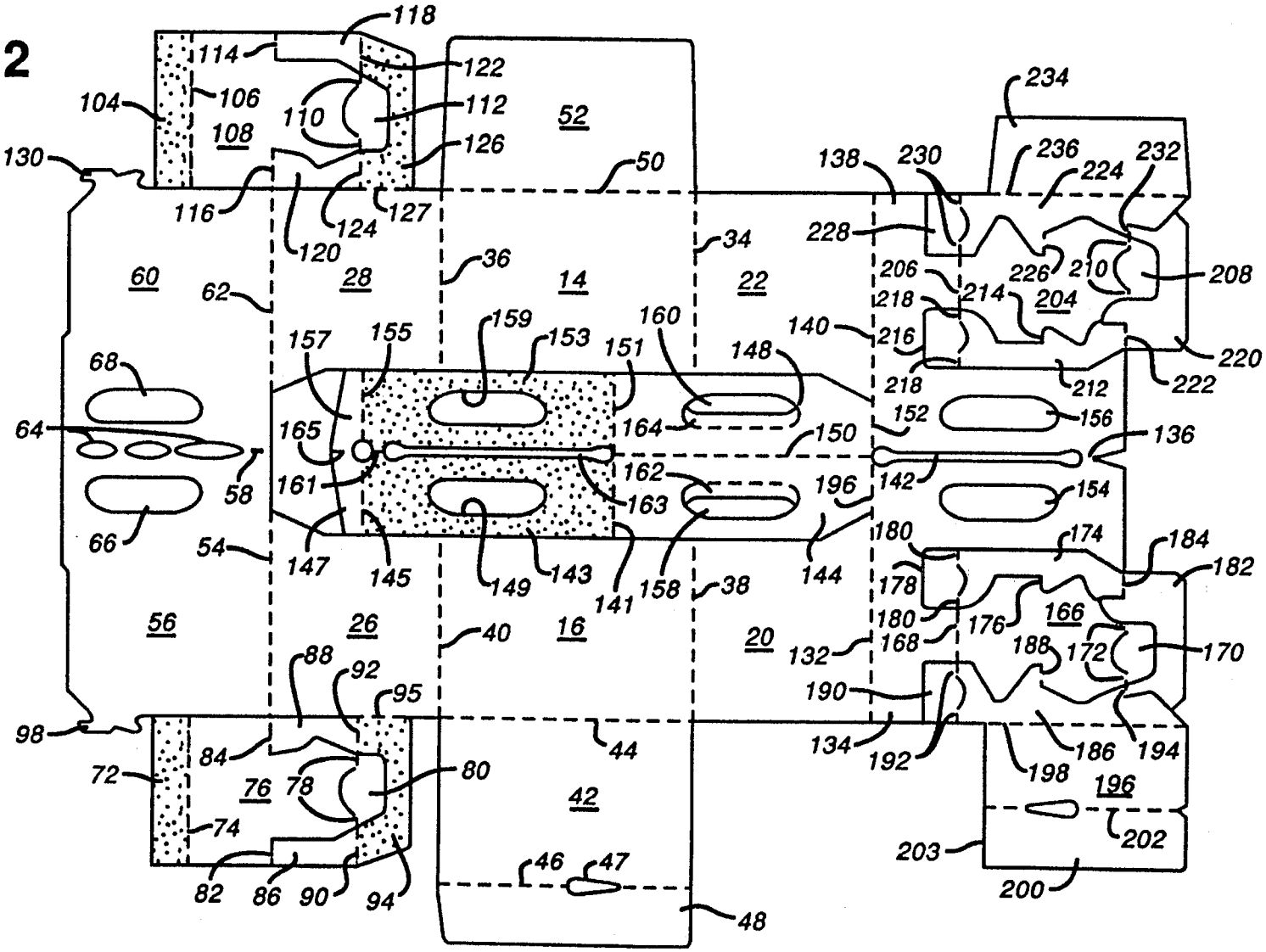
FIG. 2 is a plan view of a blank from which the carrier of FIG. 1 may be formed.

A blank from which the carrier 10 may be formed is shown in FIG. 2, the blank being shown with the inner surface visible. Side wall 14 is connected to end panel 22 along a fold line 34, and at an opposite end to end panel 28 along a fold line 36. Side wall 16 is connected at one end to end panel 20 along a fold line 38, and at an opposite end to end panel 26 along a fold line 40. Side wall 16 is also connected to primary bottom wall panel 42 along a fold line 44. Panel 42 is in turn connected along fold line 46 to a glue flap 48. Connected to side wall 14 along fold line 50 is primary bottom wall panel 52.

End panel 26 is connected along a fold line 54 to a medial panel 56. Medial panel 56 is connected along fold line 58 to a medial panel 60. Panel 60 is also connected to end panel 28 along a fold line 62. Fold line 58 includes a plurality of cutouts 64. Such cutouts 64 are included for relieving the accumulation of folded material during the folding and gluing of the blank, as is typical in the art. Additionally, medial panels 56 and 60 include openings 66 and 68, respectively, such openings cooperating to form a portion of the carton handle.

Disposed at the lower end of medial panel 56 is an attachment panel 72. Attachment panel 72 is connected by fold line 74 to a secondary partition panel 76. Partition panel 76 includes fold lines 78 which connect the outer end of partition panel 76 to an anchoring flap 80. Also, partition panel 76 is connected by fold lines 82 and 84 to primary partition straps 86 and 88, respectively. Straps 86 and 88 are connected by fold lines 90 and 92, respectively, to an anchoring flap 94. Anchoring flap 94 is connected along told line 95 to end panel 26.

Formed along the lower edge of medial panel 56 is a hook 98 used in accordance with the present invention for retaining the carrier in an erected position. Hook 98 is described in greater detail herein.

Disposed at the lower end of medial panel 60 is an attachment panel 104. Attachment panel 104 is connected by fold line 106 to a secondary partition panel 108. Partition panel 108 includes fold lines 110 which connect the outer end of partition panel 108 to an anchoring flap 112. Also, partition panel 108 is connected by fold lines 114 and 116 to primary partition straps 118 and 120, respectively. Straps 118 and 120 are connected by fold lines 122 and 124, respectively, to an anchoring flap 126. Anchoring flap 126 is connected along fold line 127 to the lower edge of end panel 28.

Formed along the lower edge of medial panel 60 is a hook 130 used in cooperation with hook 98 for retaining the carrier in an erected position as will be described in greater detail herein.

End panel 20 is connected along the fold line 132 to partial medial panel 134. Partial medial panel 134 is in turn connected along a fold line 136 to partial medial panel 138, which is also connected along fold line 140 to end panel 22. Disposed between partial medial panels 134 and 138 is a relief aperture 142 for relieving material during the folding of the blank into the completed carrier.

Also connected to partial medial panel 134 is outer handle panel 144, connected along fold line 146. Outer handle panel 144 is connected to a second outer handle panel 148 along fold line 150. Outer handle panel 148 is also connected to partial medial panel 138 along fold line 152. Outer handle panels 144 and 148 are disposed generally between, but are separated from, end panels 20 and 22.

Partial medial panels 134 and 138 are provided with apertures 154 and 156, respectively, which form a part of the handle for the completed carrier. Handle panels 144 and 148 are also provided with apertures 158 and 160, which form a portion of the handle, and further include cushioning flaps 162 and 164, respectively, which extend partially into the apertures 158 and 160, respectively, to cushion the hand of a person carrying the carrier by the handle.

Connected to outer handle panel 144 along fold line 141 is handle reinforcing panel 143, which is in turn connected along fold line 145 to handle reinforcing tab 147. Handle reinforcing panel 143 includes an aperture 149 that forms a part of the handle aperture for the completed carrier.

Connected to outer handle panel 148 along fold line 151 is handle reinforcing panel 153, which is in turn connected along fold line 155 to handle reinforcing tab 157. Handle reinforcing panel 153 includes an aperture 159 that forms a part of the handle aperture for the completed carrier.

Handle reinforcing panels 143 and 153 are connected to each other along a short fold line 161, and a relief aperture 163 is disposed between the panels 143 and 153. Handle reinforcing tabs 147 and 157 are connected by a fold line 165. A secondary partition panel 166 is connected to partial medial panel 134 along fold line 168. An anchoring flap 170 is connected at the opposite end of secondary partition panel 166 by fold lines 172. An upper primary partition strap 174 is connected to secondary partition panel 166 along fold line 176. Strap 174 includes an anchoring flap 178 connected at one end along fold lines 180, and an anchoring panel 182 connected at an opposite end along fold line 184. A lower primary partition strap 186 is also connected to secondary partition panel 166 along fold line 188. Anchoring flap 190 is connected to strap 186 along fold lines 192, while the opposite end of strap 186 is connected to anchoring panel 182 along fold line 194.

A secondary bottom panel 196 is connected to the lower edge of primary partition strap 186 along fold line 198. Secondary bottom panel 200 is connected to bottom panel 196 along fold line 202, and an aperture 203 for cooperating with hooks 98 and 130, as described in detail herein, is disposed along fold line 202.

A secondary partition panel 204 is connected to partial medial panel 138 along fold line 206. An anchoring flap 208 is connected at the opposite end of secondary partition panel 204 by fold lines 210. An upper primary partition strap 212 is connected to secondary partition panel 204 along fold line 214. Strap 212 includes an anchoring flap 216 connected at one end along fold lines 218, and an anchoring panel 220 connected at an opposite end along fold line 222. A lower primary partition strap 224 is also connected to secondary partition panel 204 along fold line 226. Anchoring flap 228 is connected to strap 226 along fold lines 230, while the opposite end of strap 226 is connected to anchoring panel 220 along fold line 232.

A secondary bottom panel 234 is connected to the lower edge of primary partition strap 224 along fold line 236.

Figure 3:
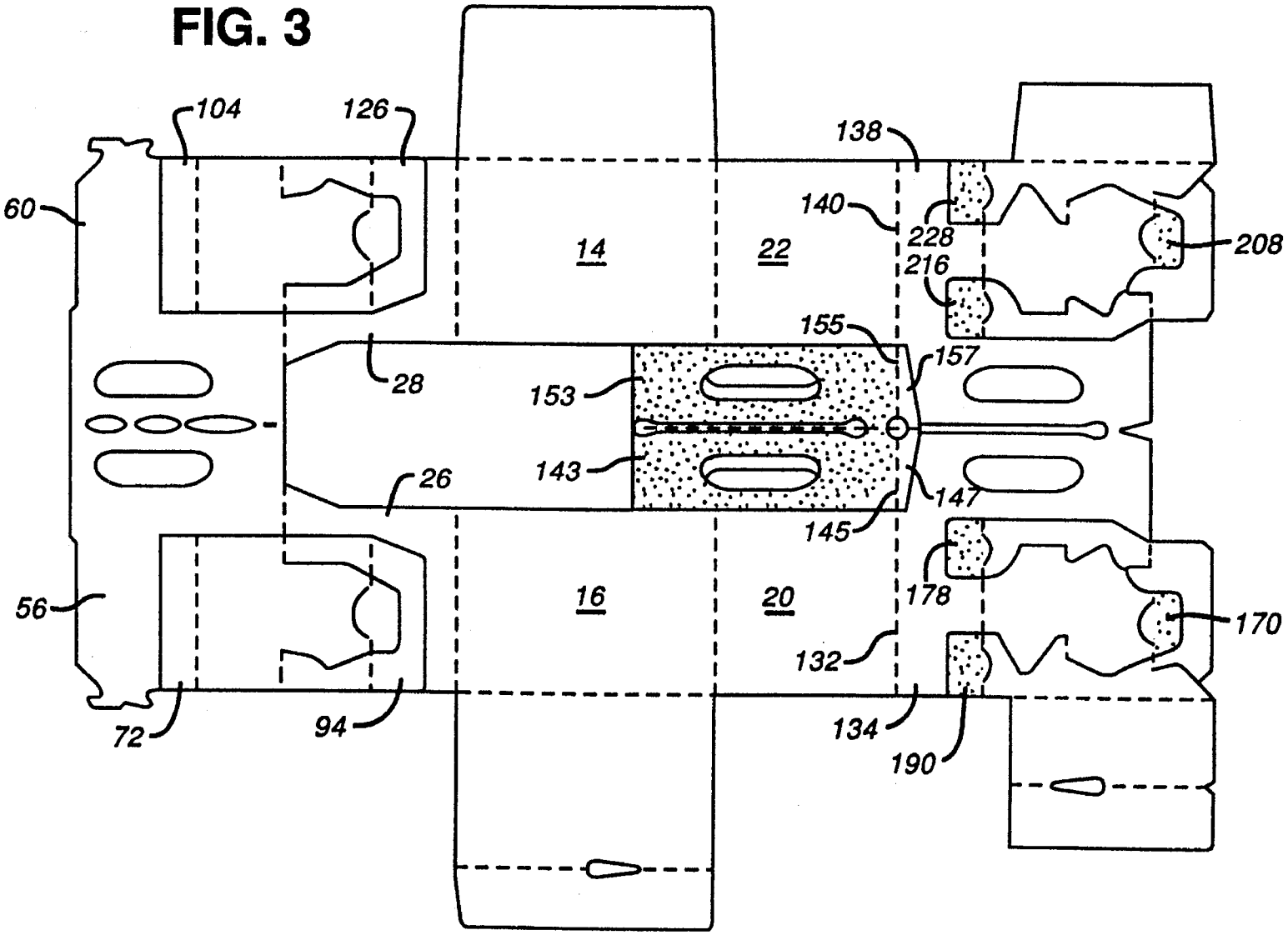
FIGS. 3–6 are a series of views showing the manner in which the blank of FIG. 2 may be folded to form the completed collapsed carrier.

To assemble the blank of FIG. 2 into the completed, collapsed carrier, glue is first applied to attachment panels 72 and 104 and anchoring flaps 94 and 126 as shown generally by cross hatching in FIG. 2. Attachment panel 72, secondary partition panel 76, straps 86 and 88 and anchoring flap 94 are then rotated along fold line 95 and positioned on medial panel 56 and end panel 26, as shown in FIG. 3. As a result of the glue which has been applied, attachment panel 72 is secured to medial panel 56, and anchoring flap 94 is secured to end panel 26.

Similarly, attachment panel 104, secondary partition panel 108, straps 118 and 120 and anchoring flap 126 are all pivoted about fold line 127 and placed in position on medial panel 60 and end panel 28 as shown in FIG. 3. Attachment panel 104 is thereby secured to medial panel 60, and anchoring flap 126 is secured to end panel 28.

Glue is also applied to handle reinforcement panels 143 and 153, which are then pivoted about fold lines 141 and 151 to position panels 143 and 153 on outer handle panels 144 and 148, respectively. This also positions handle reinforcing tabs 147 and 157 on partial medial panels 134 and 138 as shown in FIG. 3.

Figure 4:
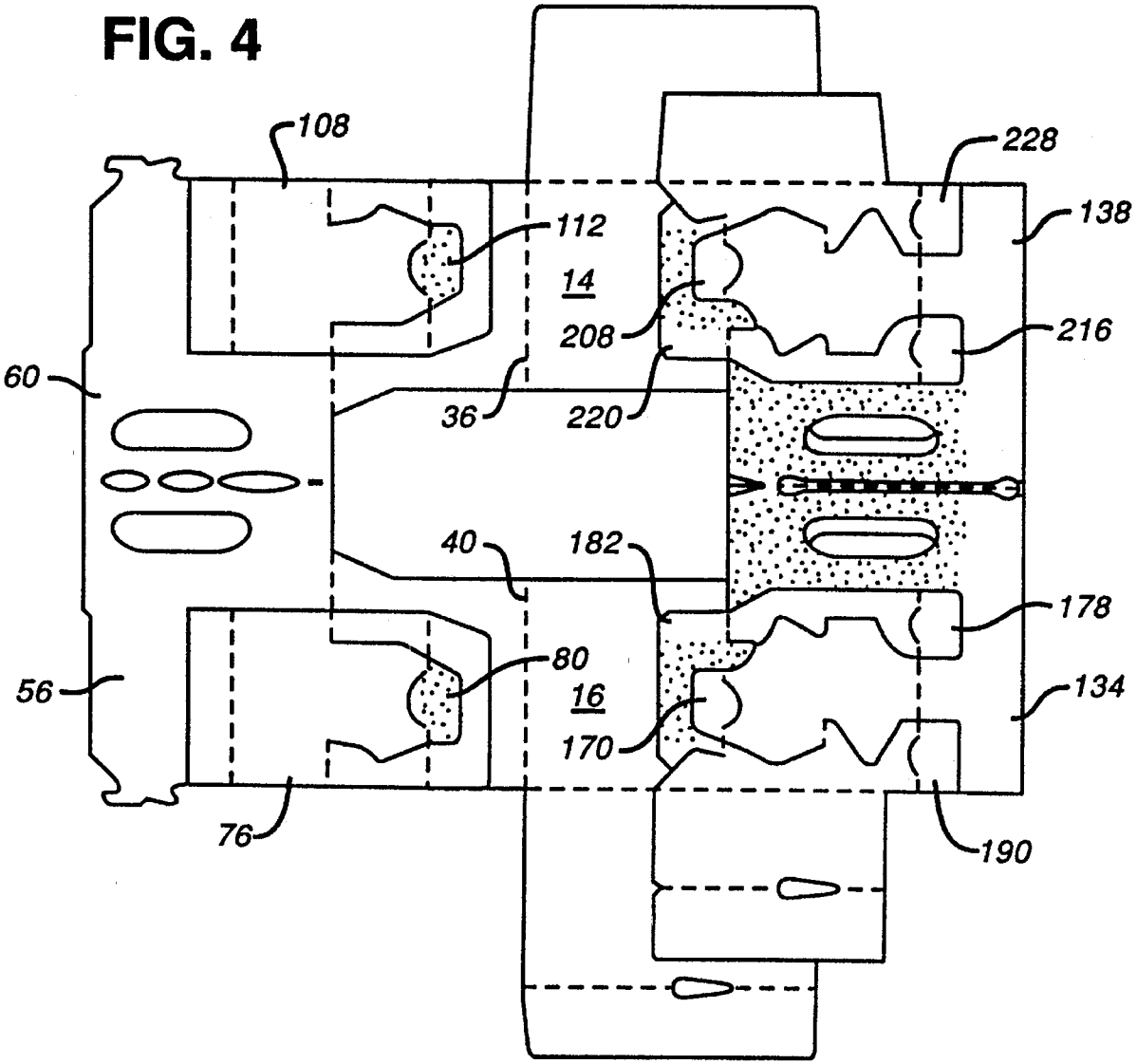

Continuing to refer to FIG. 3, glue is next applied to the opposite sides of handle reinforcing panels 143 and 153, and to anchoring flaps 170, 178, 190, 208, 216 and 228. The right hand portion of the blank as shown in FIG. 3, including partial medial panels 134 and 138, is pivoted about fold lines 132, 146, 152, 140, 145 and 155. The folded portion of the blank is then generally positioned on end panels 20 and 22 and partially on side panels 14 and 16, as shown in FIG. 4. Because of the glue previously applied, anchoring panel 170 is secured to side panel 16, anchoring panels 178 and 190 are secured to end panel 20, anchoring flap 208 is secured to side panel 14, and anchoring flaps 216 and 228 are secured to end panel 22.

For the next step in the folding and gluing of the blank, glue is applied to anchoring flaps 80 and 112 as shown in FIG. 4. Additionally, glue is applied to a portion of anchoring panels 182 and 220, and to partial medial panels 134 and 138 in the vicinity of apertures 154 and 156. After the application of glue, the left hand portion of the blank as shown in FIG. 4 is folded along fold lines 36 and 40, thereby folding end panels 26 and 28 and medial panels 56 and 60 into overlapping relationship with side panels 14 and 16 and partial medial panels 134 and 138. As a result of the glue previously applied, anchoring flap 80 is secured to side panel 16, while anchoring flap 112 is secured to side panel 14. Anchoring panel 182 is secured to a portion of secondary partition panel 76, and anchoring panel 220 is secured to a portion of secondary partition panel 108. Additionally, medial panels 56 and 60 are secured to partial medial panels 134 and 138, respectively. The partially completed carrier then appears as shown in FIG. 5.

Figure 5:
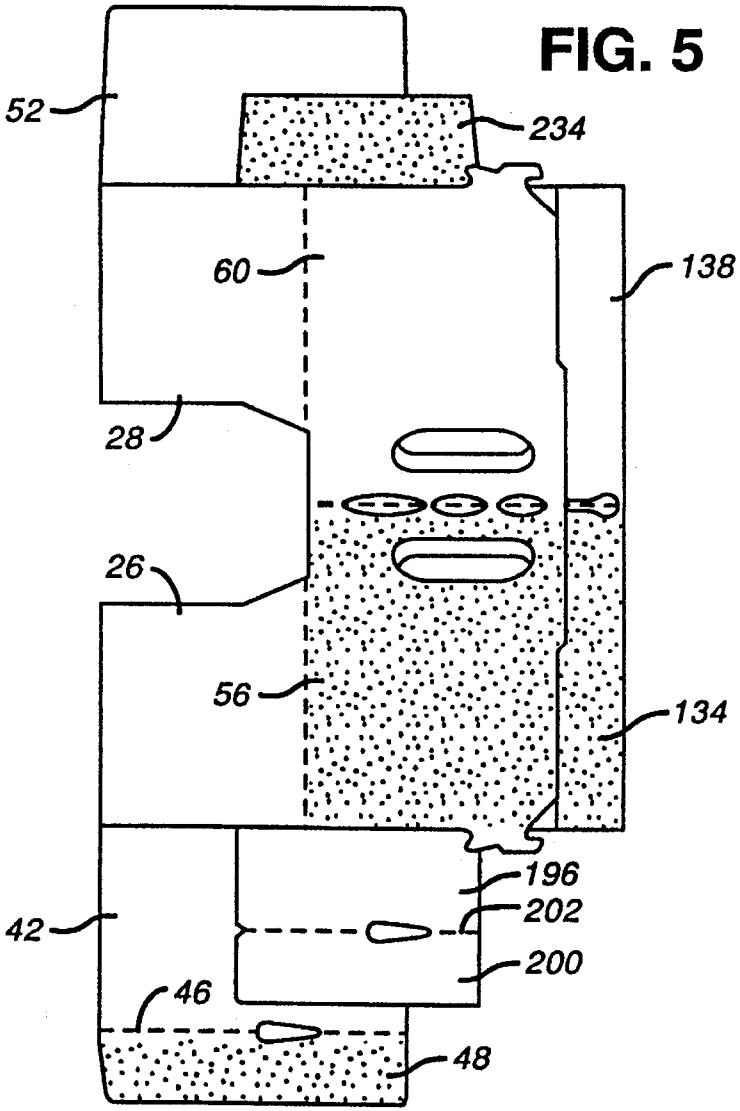

As the final step in the gluing and folding process, glue is applied as shown in FIG. 5 to medial panel 56 and partial medial panel 134. Glue is also applied to secondary bottom panel 234 and glue flap 48. The upper portion of the partially completed carton shown in FIG. 5 is then folded along fold line 58 to secure medial panel 60 to medial panel 56 and partial medial panel 138 to partial medial panel 134. Secondary bottom panel 200 is then folded along fold line 202 to secure bottom panel 200 to secondary bottom panel 234. Finally, glue flap 48 is folded along fold line 46 to secure primary bottom panel 52 to the outer surface of side panel 14.

Figure 6:
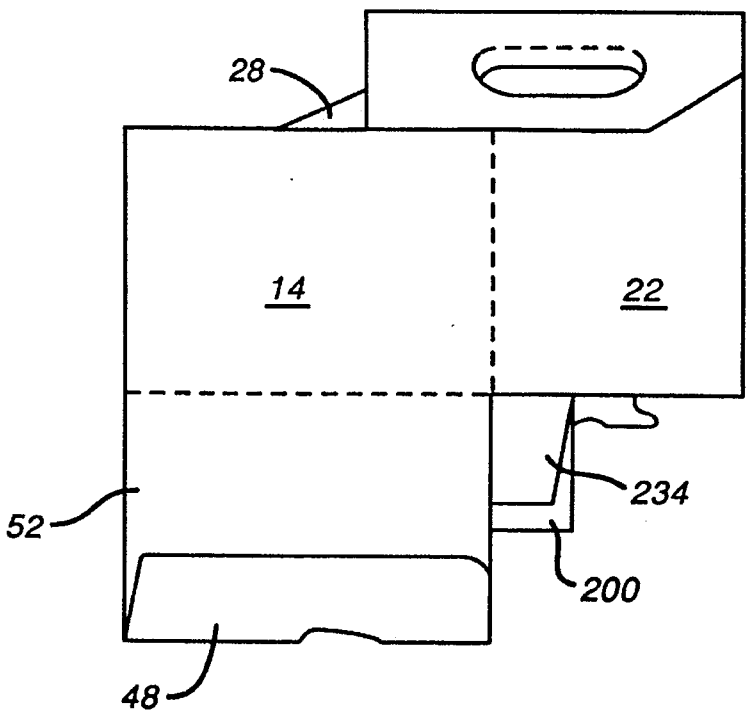

The completed and collapsed carton is shown in FIG. 6.

Figure 7:
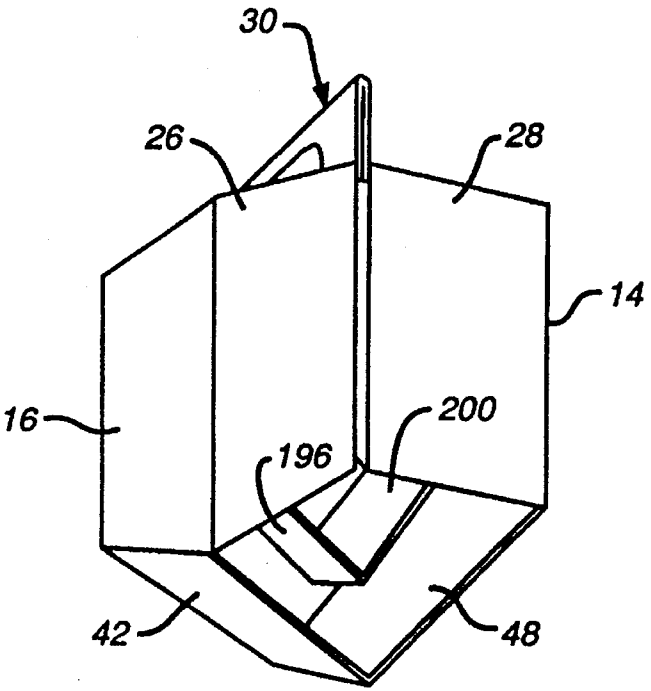
FIG. 7 is a perspective view of the carrier shown in an intermediate position during set up from a collapsed to erected carrier.

The carton may be erected as shown in FIG. 7. Side walls 14 and 16 are moved longitudinally with respect to the medial panel structure 30. As a result, end panels 20, 22, 26 and 28 are moved into position to form the end walls 18 and 24 as shown in FIG. 1. Such a method of erecting is typical of basket-style carriers of the prior art.

As shown in FIG. 7, however, the carrier of the present invention forms a double bottom structure. A primary bottom wall 235 is formed from primary bottom panels 42 and 48, connected to side walls 14 and 16. Panels 42 and 48 move into a planar relationship as the carton is erected, thereby forming the primary bottom wall.

In a similar manner, the secondary bottom wall 237 is formed from secondary bottom panels 196 and 200. These panels are connected to the primary partition structure (refer back, for example, to FIG. 2). Set up of the carrier causes panels 196 and 200 to move into a planar position, thereby creating a secondary bottom wall which extends between the primary partition structures. As a result, bottles or other articles which are loaded into the carton into the outermost rows will be positioned only on the primary bottom wall, on one of the panels 42 and 48. Bottles or other articles positioned on the innermost two rows will be supported by a double-ply bottom structure, and will be disposed on either panel 196 or 200, which will in turn be positioned in contact with panel 42 or 48, respectively.

Figure 8:
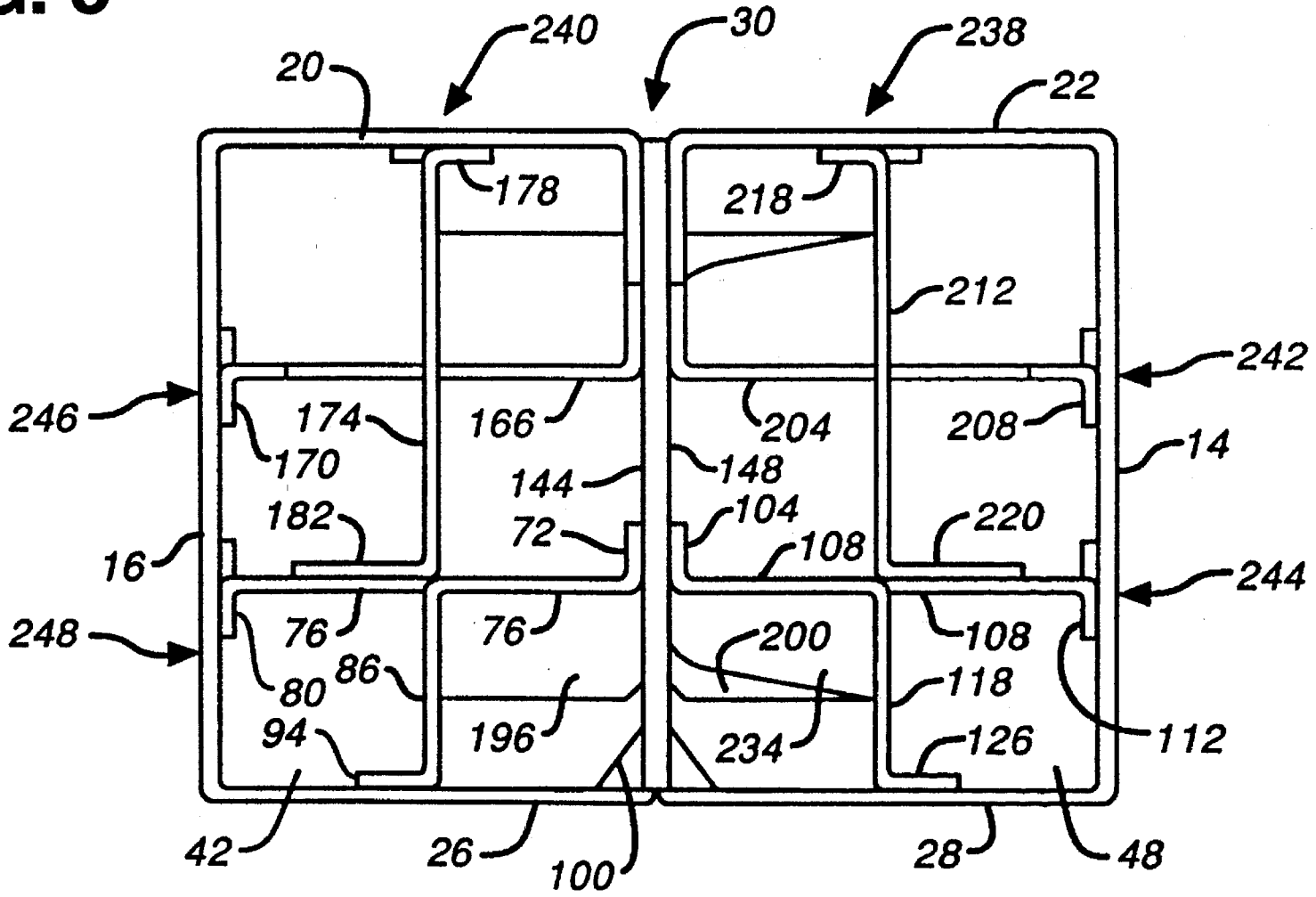
FIG. 8 is a top plan view of the carrier of FIG. 1, shown with the articles removed.

Further reference may be made to FIG. 8, which shows the erected carrier in top plan view. From FIG. 8, it can be seen that the first primary partition structure 238 is positioned between side wall 14 and medial panel structure 30, and is comprised of strap 212 (and strap 224, not shown) and strap 120 (and strap 118, not shown). A second primary partition structure 240 is disposed between medial panel structure 30 and side wall 16, and comprises strap 174 (and strap 186, not shown) and strap 86 (and strap 88, not shown). Secondary partition structure 242, comprised of secondary partition panel 204 and secondary partition structure 244, comprised of secondary partition panel 108, interconnects side wall 14, primary partition structure 238, and medial panel structure 30. Secondary partition structure 246, comprised of secondary partition panel 166, and secondary partition structure 248, comprised of secondary partition panel 76, interconnects side wall 16, primary partition structure 240 and medial partition structure 30. The primary and secondary partition structures together define a plurality of cells for receiving the bottles or other articles to be packaged within the carrier.

Figure 9:
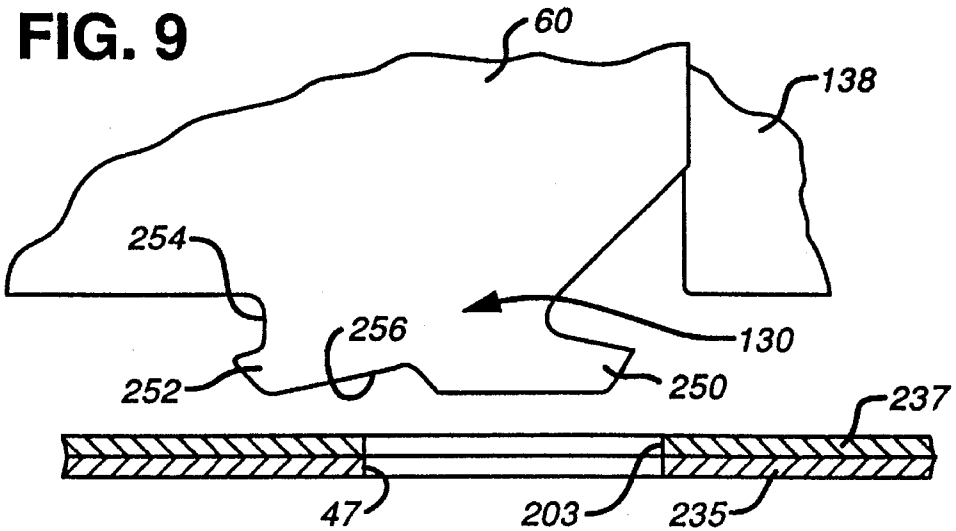
FIGS. 9–12 are a series of views of a portion of the carrier medial panel and bottom walls, showing the manner in which the lock of the present invention may be engaged.

The operation of the lock for maintaining the carrier in erected condition can be seen by reference to FIGS. 9–12. In FIG. 9, a fragment of an erected carton, shown just prior to locking of the bottom wall, can be seen. A portion of medial panel 60 and corresponding partial medial panel 138 is shown, it being understood that the medial wall is in fact a two-ply structure comprising in addition medial panel 56 disposed behind medial panel 60, and partial medial panel 134 disposed behind partial medial panel 138.

Hook 130 is disposed at the lower edge of medial panel 60, it being understood that hook 98 is disposed immediately behind hook 130 to form a two-ply structure. Hook 130 includes a first locking tab 250 that extends from the hook 130 to the right as shown in FIG. 9. A second locking tab 252 extends from the hook to the left as shown in FIG. 9. Tabs 250 and 252 therefore form a narrowed portion or neck for the hook body, shown in FIG. 9 generally as 254. Further, an upward extending notch 256 is defined in the lower edge of hook 130.

FIG. 9 shows the carton portion just prior to locking, with superposed primary bottom wall 235 and secondary bottom wall 237 disposed beneath the hook 130. Referring additionally back to FIG. 2, it can be seen that bottom wall 235 includes a locking aperture 47, while secondary bottom wall 237 includes a locking aperture 203. When the carton is erected, these apertures are disposed in superposed position, aligned as shown in FIG. 9.

At the beginning of the locking procedure, the bottom walls 235 and 237 are positioned as shown in FIG. 9, moved slightly to the right with respect the remaining portion of the carrier, including medial panel 60 and hook 130. As a result, the left edge of apertures 47 and 203 are generally aligned with notch 256, while the right edge of the apertures are positioned beyond the outermost edge of tab 250.

Figure 10:
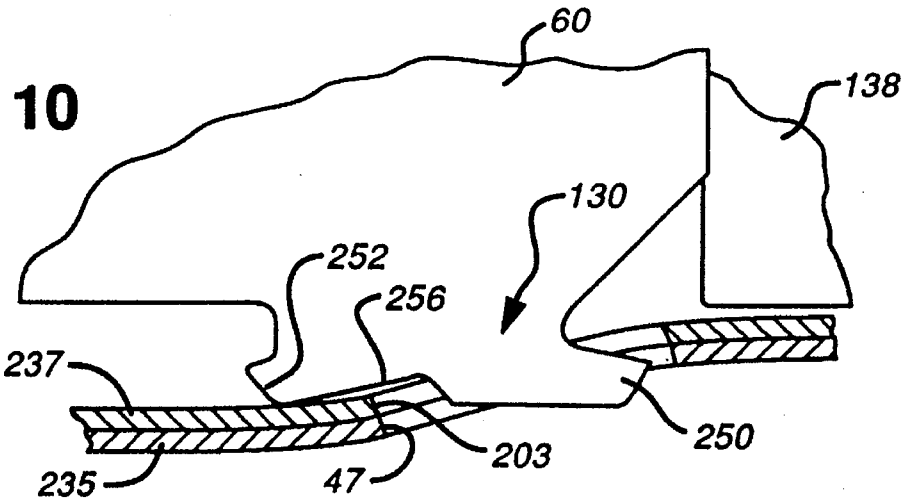

Referring now to FIG. 10, bottom walls 235 and 237 are moved upwardly. As a result, tab 250 is passed through apertures 47 and 203. The left edges of these apertures are received into notch 256, so that bottom walls 235 and 237 are still positioned beneath locking tab 252. Tab 250 as a result completely passes through apertures 47 and 203.

Figure 11:
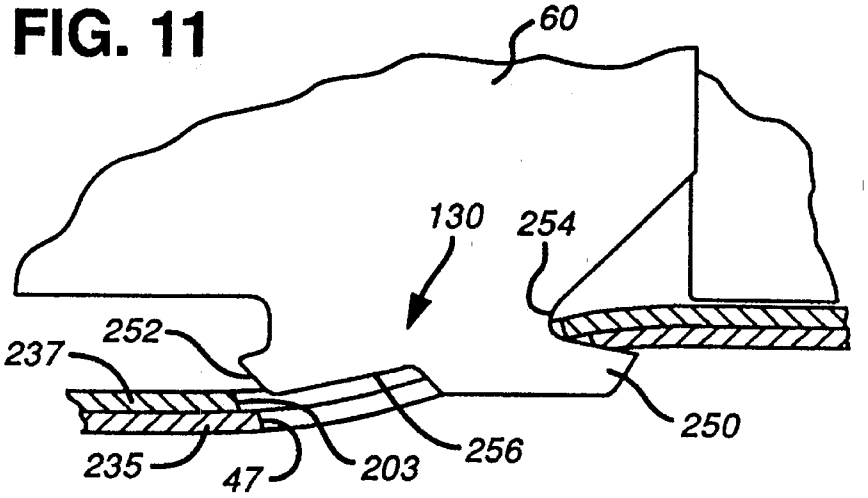
Figure 12:
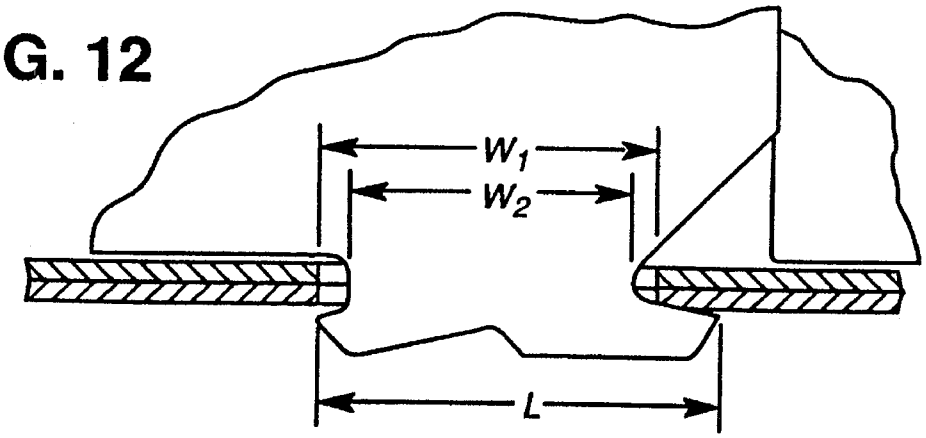

Referring now to FIG. 11, bottom walls 235 and 237 are moved to the left as shown in FIG. 11 with respect to hook 130. This draws the right hand edges of apertures 47 and 203 against the throat 254 of the hook 130, and moves the left hand edges of apertures 47 and 203 beyond the outermost edge of hook 252. As shown in FIG. 12, bottom walls 235 and 237 are then moved completely upward so that the left most edges of apertures 47 and 203 pass beyond locking tab 252. Apertures 47 and 203 now assume a position completely within throat 254 of hook 130. Because the dimensions of the lock are determined such that the width $W_1$ of the lock throat is less than the length $W_2$ of the apertures, which is in turn less than the retention width $l_2$ between the outermost edges of tabs 250 and 252, hook 130 will be retained within apertures 47 and 203, thereby forming a lock which maintains the carton in an erect condition.

In addition to maintaining the carton in an erect condition, it will be recognized that the lock described herein is particularly useful in preventing a condition sometimes experienced with basket carriers known as "racking". This condition is most severe in cartons for large numbers of bottles, such as the arrangement for four rows described in the preferred embodiment herein. During carrying of the loaded carrier, the natural swinging motion of the arm of the user will tend to cause the bottles to move back and forth with respect to the carrier handle. Without a retaining lock such as that provided by the present invention, the carton will slightly skew in a forward and reverse direction in response to this bottle movement, thereby producing noise as the bottles move in contact with each other, creating the potential for possible bottle breakage, and giving an impression to the user that the package is of insufficient stability.

Of course, it will be recognized that the present invention need not be used with a carton for four rows of bottles, nor with a carton which includes a double bottom wall structure. It can be used advantageously with a more conventional basket carrier for two rows of bottles, such carrier having a single-ply bottom wall.

Still other variations will be readily apparent to those skilled in the art from the foregoing description of the preferred embodiment, the accompanying drawings and the appended claims.

What is claimed is:

1. A carrier for a plurality of objects arranged in at least two rows, the carrier comprising:

substantially vertical parallel first and second side walls;

substantially parallel first and second end walls interconnecting said side walls;

a medial panel extending between and connected to said first and second end walls, said medial panel defining a lower edge and being disposed between and substantially parallel to said first and second side walls;

a primary bottom wall connected and extending between lower portions of said first and second side walls and underlying said medial panel; and a lock for maintaining the carrier in an erect condition, the lock comprising:

a lock body connected to a lower edge of said medial panel and depending downwardly therefrom, said lock body defining first and second side edges;

a first retention tab disposed along said first side edge of said lock body spaced from said medial panel, and a second retention tab disposed along said second side edge of said lock body spaced from said medial panel, whereby said first and second retention tabs define a retention width for said lock extending between the outermost portions of said first and second retention tabs, and a throat for said lock body having a throat width extending between said first and second edges between said retention tabs and said medial panel; and said primary bottom wall defining a locking aperture therein for cooperative engagement with said lock when said carrier is in an erected condition, said aperture being in vertical alignment with said lower edge of said medial panel, and having a length along said alignment which is less than said retention width and greater than said throat width.

2. A carrier as claimed in claim 1 wherein said lock body further defines a lowermost edge between said first and second retention tabs, and a retention notch defined in said lowermost edge for temporarily retaining an edge of said locking aperture during engagement of said aperture with said lock body.

3. A carrier as claimed in claim 1 wherein said locking aperture is cooperatively engaged with said throat extending through said aperture whereby said first and second retention tabs are disposed beneath said primary bottom wall.

4. A combination of a lock and a collapsible carrier for maintaining a plurality of objects in an erected condition, the carrier including substantially vertical parallel first and second side walls, substantially parallel first and second end walls interconnecting said side walls, a medial panel extending between and connected to said first and second end walls, said medial panel defining a lower edge and being disposed between and substantially parallel to said first and second side walls, and a primary bottom wall connected and extending between lower portions of said first and second side walls and underlying said medial panel, the lock comprising:

a lock body connected to a lower edge of the medial panel and depending downwardly therefrom, said lock body defining first and second side edges;

a first retention tab disposed along said first side edge of said lock body spaced from the medial panel, and a second retention tab disposed along said second side edge of said lock body spaced from the medial panel, whereby said first and second retention tabs define a retention width for said lock extending between the outermost portions of said first and second retention tabs, and a throat for said lock body having a throat width extending between said first and second edges between said retention tabs and said medial panel; and said primary bottom wall defining a locking aperture therein for cooperative engagement with said lock when the carrier is in an erected condition, said aperture being in vertical alignment with said lower edge of said medial panel, and having a length along said alignment which is less than said retention width and greater than said throat width.

5. A lock as claimed in claim 4 wherein said lock body further defines a lowermost edge between said first and second retention tabs, and a retention notch defined in said lowermost edge for temporarily retaining an edge of said locking aperture during engagement of said aperture with said lock body.

6. A lock as claimed in claim 5 wherein said locking aperture is cooperatively engaged with said throat extending through said aperture whereby said first and second retention tabs are disposed beneath said primary bottom wall.

7. A method for locking a collapsible carrier for a plurality of objects into an erected condition;

the carrier including substantially vertical parallel first and second side walls, substantially parallel first and second end walls interconnecting said side walls, a medial panel extending between and connected to said first and second end walls, said medial panel defining a lower edge and being disposed between and substantially parallel to said first and second side walls, and a primary bottom wall connected and extending between lower portions of said first and second side walls and underlying said medial panel;

the lock comprising a lock body connected to a lower edge of the medial panel and depending downwardly therefrom, said lock body defining first and second side edges;

a first retention tab disposed along said first side edge of said lock body spaced from the medial panel, and a second retention tab disposed along said second side edge of said lock body spaced from the medial panel, whereby said first and second retention tabs define a retention width for said lock extending between the outermost portions of said first and second retention tabs, and a throat for said lock body having a throat width extending between said first and second edges between said retention tabs and said medial panel; and said primary bottom wall defining a locking aperture therein for cooperative engagement with said lock when the carrier is in an erected condition, said aperture being in vertical alignment with said lower edge of said medial panel, and having a length along said alignment which is less than said retention width and greater than said throat width;

the method comprising the steps of:

causing relative lateral movement between said medial panel and said primary bottom wall to position said locking aperture beneath said lock such that said first retention tab is in alignment with said aperture;

causing relative vertical movement between said medial panel and said primary bottom wall to cause said first retention tab to pass through said locking aperture but with an edge of said aperture disposed against a lowermost edge of said lock body between said first and second retention tabs;

causing relative lateral movement between said medial panel and said primary bottom wall to move said locking aperture inwardly into said lock throat adjacent said first retention tab;

causing relative vertical movement between said medial panel and said primary bottom wall to cause said second retention tab to pass through said locking aperture.

8. A method as claimed in claim 7 wherein said lowermost edge of said lock body defines a retention notch, and wherein said edge of said aperture when disposed against said edge of said lock body is disposed within said notch.

* * * * *